US007845376B2

(12) United States Patent
Boswell et al.

(10) Patent No.: US 7,845,376 B2
(45) Date of Patent: Dec. 7, 2010

(54) MACHINE AND METHOD FOR THE SELECTION AND THE ARRANGEMENT OF STAVES

(75) Inventors: James Bradley Boswell, Columbia, MO (US); Patrick Eisen, Ville sur Illon (FR)

(73) Assignee: Independent Stave Co., Inc., Lebanon, MO (US)

( * ) Notice: Subject to any disclaimer, the term of this patent is extended or adjusted under 35 U.S.C. 154(b) by 55 days.

(21) Appl. No.: 12/440,431

(22) PCT Filed: Aug. 27, 2007

(86) PCT No.: PCT/FR2007/051838

§ 371 (c)(1), (2), (4) Date: Mar. 6, 2009

(87) PCT Pub. No.: WO2008/037903

PCT Pub. Date: Apr. 3, 2008

(65) Prior Publication Data

US 2010/0037989 A1 Feb. 18, 2010

(30) Foreign Application Priority Data

Sep. 28, 2006 (FR) ..... 06 08521

(51) Int. Cl.
*B27H 5/02* (2006.01)

(52) U.S. Cl. ..... 147/1

(58) Field of Classification Search ..... 147/1, 147/18–23; 700/167, 171
See application file for complete search history.

(56) References Cited

U.S. PATENT DOCUMENTS 3,613,757 A * 10/1971 Humphrey ..... 147/1
4,221,974 A 9/1980 Mueller et al.

FOREIGN PATENT DOCUMENTS

FR 2856329 12/2004
FR 2863537 6/2005

* cited by examiner

*Primary Examiner*—Mark Rosenbaum
(74) *Attorney, Agent, or Firm*—Egbert Law Offices PLLC

(57) ABSTRACT

The present invention relates to a machine and method for selecting and organizing staves for making barrels. The machine includes an input unit, including a stave-measuring station, a storage assembly for storing the staves awaiting allocation and receiving the staves from the input and measuring unit, a calculation unit able to select staves from those measured in such a way as to form a collection of staves ready to assemble into a barrel, and an output unit, in relation with the storage assembly, equipped with a stave-reorientation system. Staves used by the machine and in the method may be asymmetric about a horizontal axis. The staves selected by the calculation unit are advantageously delivered to the output unit in an order and a configuration that make for easy assembly of the barrel.

10 Claims, 2 Drawing Sheets

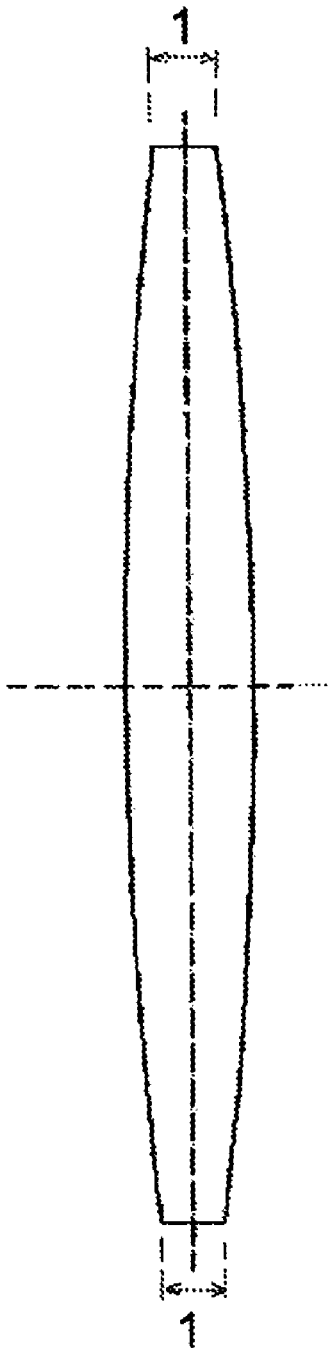
Fig. 1a
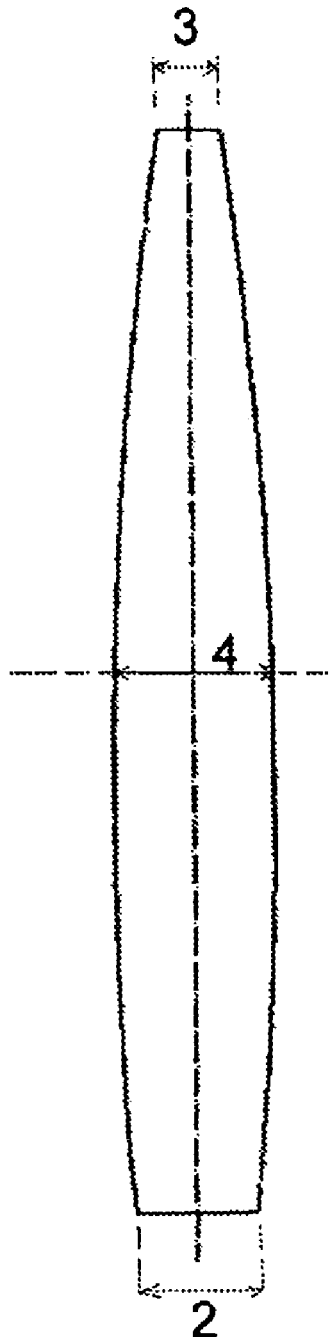
Fig. 1b
FIG. 1

MACHINE AND METHOD FOR THE SELECTION AND THE ARRANGEMENT OF STAVES

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to a machine for selecting and organizing staves for making barrels.

2. Description of Related Art Including Information Disclosed Under 37 CFR 1.97 and 37 CFR 1.98

Barrels made in the field of cooperage are manufactured from pieces of wood known as staves which are assembled, then bent contiguously to form the side wall of the barrels. Metal hoops hold the staves in position.

The staves are manufactured by machining pieces of oak so as to make use of the flexibility and watertight characteristics of the wood split along the grain.

The oak used to manufacture barrels is used because of the specific properties of this wood which alter the organoleptic characteristics of the wines and liqueurs contained in the casks.

The barrels are manufactured as follows:

- the manufacturer selects oak from various sources,
- the wood arrives at the splitting shops in the form of raw logs and is converted into bolts,
- the bolts are split into billets and the billets are sawn into slats,
- the slats are stored in the open air and seasoned for 12 to 36 months minimum, according to the thickness,
- after this seasoning operation the slats are made into staves which staves are then assembled to form barrels.

All of this procedure of preparing the wood and the stave makes the elemental item that makes up the barrel expensive. This expense is further heightened by the cost of oak itself.

The manufacturing methods currently in use in cooperages allow the use only of staves which are symmetric about a horizontal axis and about the vertical axis for making the barrels, these restrictions leading to appreciable waste in terms of materials and therefore appreciable additional costs which are passed on to the price of the casks.

It is an objective of the invention to resolve these main difficulties by proposing a machine able to select and organize the staves, without manual intervention, so as to form a collection of parts ready to be assembled to make a barrel.

BRIEF SUMMARY OF THE INVENTION

The present invention relates to a method and a machine for selecting and organizing staves for making barrels, the machine being characterized in that it comprises at least:

- an input unit including a stave-measuring station,
- a storage assembly for storing the staves awaiting allocation, this assembly receiving the staves from the input and measuring unit,
- a calculation unit able to select staves from those measured in such a way as to form a collection of staves ready to assemble into a barrel,
- an output unit, in relation with the storage assembly, equipped with a stave-reorientation system.

The staves used in the invention may be symmetric or asymmetric about a horizontal axis, the two end widths not necessarily being equal.

In the machine according to the invention the staves selected by the calculation unit are advantageously delivered to the output unit in an order and a configuration that makes for easy assembly of the barrels.

There are many advantages to the machine for selecting and organizing staves for the making of barrels according to the invention:

Mainly, the machine allows the use of staves that are symmetric only about the vertical axis, rather than about both, horizontal and vertical, axes, thus making it possible to save up to 20% on wood by comparison with the conventional machining of staves.

The machine is fully automated and is able to deliver staves ready to be assembled into a barrel, without human intervention, thus saving time and appreciably improving productivity in cooperages.

The machine is capable of sorting the staves and, in particular, of rejecting staves that cannot be used or are out of specification, and, by means of the calculation unit, determines barrel assembly configurations that a human operator would find impossible to calculate.

According to the barrel to be assembled, and to the specified characteristics, the machine alone selects and organizes the staves, determines whether or not it is feasible and can continue to operate until it finds the correct assembly configuration.

To sum up, the machine allows a saving on wood and on the time it takes to produce the sets of staves.

BRIEF DESCRIPTION OF THE SEVERAL VIEWS OF THE DRAWINGS

Other features and advantages of the invention will become apparent from the description which will follow of the attached drawings, which are given merely by way of non-limiting examples.

FIG. 1 depicts schematic views of two staves, FIG. 1*a* corresponding to a stave as currently used in cooperages, and FIG. 1*b* being a stave that is symmetric about the vertical axis only and being used in the machine according to the invention.

DETAILED DESCRIPTION OF THE INVENTION

Figure 2:
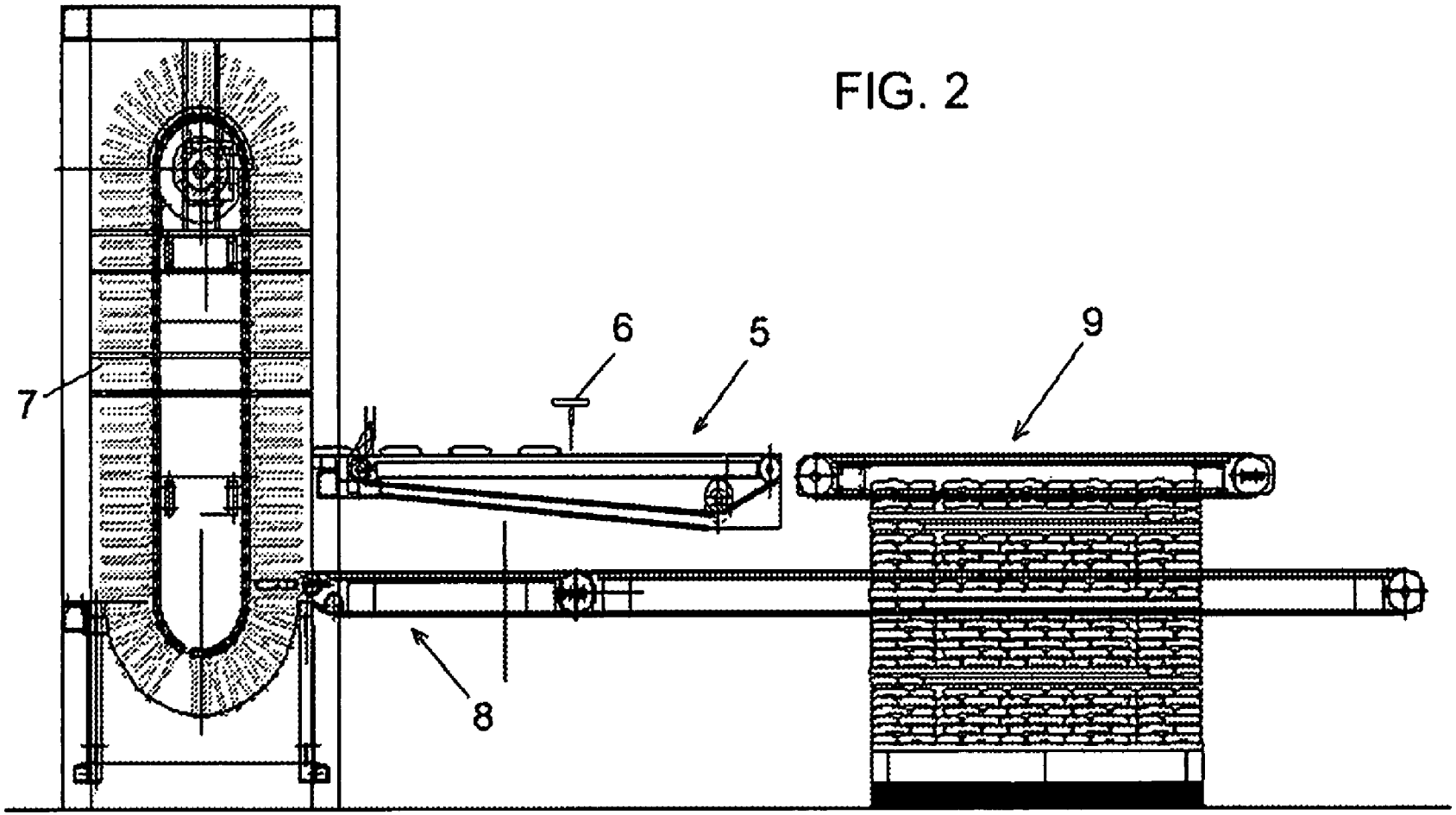
FIG. 2 is a schematic view of the operation of the machine for selecting and organizing staves for making barrels according to the invention.

Two examples of staves are depicted in FIG. 1, the staves conventionally used in cooperages are symmetric about the vertical axis and about the horizontal axis, as depicted in FIG. 1*a*. These staves have two equal widths at their ends, these being referenced 1.

The invention allows the use of these usual staves, which are fully symmetric, but also allows the use of staves that are symmetric only about the vertical axis, as illustrated in FIG. 1*b*, such staves having different end widths referenced 2 and 3. The width in the middle of the stave, referenced 4, is useful in calculating the characteristics of the barrel that can be achieved.

One essential advantage of a machine according to the invention is that the staves used can be asymmetric about a horizontal axis, that is to say that the two end widths are not equal.

According to the invention and as illustrated in FIG. 2, the machine for selecting and organizing staves for making barrels, is characterized in that it comprises, at least:

- an input unit including a stave-measuring station,
- a storage assembly for storing the staves awaiting allocation, this assembly receiving the staves from the input and measuring unit,
- a calculation unit able to select staves from those measured in such a way as to form a collection of staves ready to assemble into a barrel, and
- an output unit, in relation with the storage assembly, equipped with a stave-reorientation system and preferably delivering the said staves in the order and configuration for assembling the barrel.

The machine for selecting and organizing the staves comprises an input unit referenced 5 in FIG. 2, advantageously of the button conveyer type, on which the staves are placed transversely. This conveyer comprises a measuring station 6 in the form of an array of three laser cells coupled to an encoder. Various other measurement devices, such as a means using a camera, for example, are conceivable within the context of the invention.

The measurement station 6 is able to measure the width of each stave at the required positions referenced 2, 3 and 4 in FIG. 1*b* and to assign a virtual reference to each stave. This reference is used to track the stave throughout the machine.

According to the invention, the input and measuring unit is able to establish the width of each stave at its middle and at its two ends and supplies the storage assembly 7 with staves awaiting allocation.

The measurement station 6 transmits the information received and assigns a virtual reference to each stave entering the storage assembly, this information being communicated to the calculation unit whose task it is to select and organize the staves with a view to forming a set of staves that can be used directly to make the barrel.

Thus, according to the invention, each stave entering the awaiting-stave storage assembly 7 is measured beforehand and receives a virtual reference that can be used by the calculation unit.

The storage assembly 7 for storing staves awaiting allocation, may adopt various forms, but preferably, according to the invention, the storage assembly is formed of a storage device comprising a number of places greater than the number of staves needed to make a barrel.

Staves awaiting allocation and delivered by the calculation unit are transported by an endless conveyer comprising a high number of places so as to accommodate sufficient staves to form the barrel, and since not all of the staves will be satisfactory, the number of places, and therefore the stave storage capacity will advantageously be 72 or more.

According to the invention, the storage device is vertical and is in the form of an endless conveyer, a storage device of this type taking up less floor space than a flat conveyer and therefore allowing a more compact machine to be produced.

This storage device, loaded with staves by means of the input and measuring unit, may have one or more outputs via which the staves are removed once they have been allocated by the calculation unit.

According to the invention, the calculation unit works with the widths measured on each stave and is able, on the basis of the characteristics of the barrel to be assembled, to select the staves to be used from the storage assembly, particularly by reorientating the said staves in an output unit 8.

The calculation unit is able to determine the permissible tolerances for assembling the barrel and for the individual staves.

The machine comprises at least one output unit 8 equipped with a device for rotating the staves in a horizontal plane and setting the selected staves down on an output conveyer belt to form the barrel in the optimum order and configuration for assembly, which belt may be connected to an end storage station.

Rotating the staves in a horizontal plane, reorientating or turning the staves over, must be understood to mean an operation which has the effect of turning the stave through 180° in its own plane and with respect to its center, the plane of the stave being parallel or identical to the plane of loading into or offloading from the storage device. The said rotation therefore has the effect of swapping the end widths of a stave at output from the machine with respect to the orientation it had when loaded into the machine.

In fact, and this is a key point of the invention, a stave the widths 2 and 3 of which are different, can be used just as well one way up as the other, that is to say with the width 2 at the top or at the bottom of the barrel to be assembled, depending on the optimum configuration as determined by the calculation unit.

The machine according to the invention is capable of getting at least fifteen sets of staves or so ready to be assembled per hour.

Advantageously, the staves are delivered by the storage unit in the order of assembly ordained by the calculation unit and lying flat on a conveyer belt, although an important alternative form of the invention involves extracting the selected staves in the best order for ejecting them from the storage device and, even marking these staves at output so that the ordained order of assembly can be regained, or using an independent sorting unit to form the staves into the order of assembly as defined by the calculation unit. An alternative form such as this improves the productivity of the machine and allows more collections of staves ready for assembly to be produced. In this alternative form about forty collections of staves can be produced per hour.

The output unit 8 may comprise an end storage and possibly marking station to form sets of staves ready to be assembled into barrels, this end storage perhaps consisting in stacking and banding the staves so that they can be transported to a distant assembly site.

Advantageously, according to the invention, the machine for selecting and organizing staves comprises a unit, referenced 10 in FIG. 2, for ejecting unusable staves so that the parts can be removed from the storage assembly.

There may be various reasons why these ejected staves cannot be used, particularly if their dimensions are out of specification or if it is impossible to find a combination of staves that will allow a barrel to be built.

The invention also relates to a method for selecting and organizing staves for forming a set of staves that can be used to assemble a barrel, the said method comprising the following steps:

measuring three widths on each stave of a collection of staves, storing a collection of staves in a storage assembly 7, with each item virtually referenced, selecting staves from the collection of measured staves, using a calculation unit, and forming a set of staves on an output unit 8, this output unit 8 comprising a device for reorientating the staves.

In the method in question, the staves used may be asymmetric about a horizontal axis, the two end widths not necessarily being equal, and the staves selected by the calculation unit are advantageously delivered to an output unit 8 in an order and configuration that make for easy assembly of the barrel.

There are several possible forms that the machine for selecting and organizing the staves can take: for example, it is possible to envisage various conveying means and a feed unit 9, as depicted in FIG. 2, for supplying the measurement station and storage assembly, which station for storing the staves awaiting allocation may be designed in various ways, with or without an endless conveyer, in a vertical or horizontal configuration, and in such a way as to be able to store a greater or lesser number of staves without departing from the scope of the invention.

Alternative forms may also be envisaged as regards the device for rotating the staves and the delivery of the set of staves which have been organized by the machine, and finally, there are various possible ways of storing the said set, without departing from the scope of the invention.

Finally, the machine may possibly be designed with several output lines and/or several lines for feeding staves into the storage device in the context of the invention.

The calculation unit may be connected to a display device to show the machine working, the selected staves and final barrel formed, and to any computer and software means for registering the work performed by the machine. The calculation unit may also have alarm means allowing the operator to choose how the machine works, particularly when it appears that no barrel can be made with the staves contained in the storage assembly.

It may also be envisaged for the calculation unit to drive a stave-marking station to indicate the assembly order to be followed. This marking station would then preferably be positioned after the stave-turning device and before the end storage facility.

Additional peripheral units, such as chains for reinserting ejected staves, one or more storage circuits, may advantageously be incorporated into the machine without departing from the scope of the invention.

Of course, the invention is not restricted to the embodiments described and depicted by way of examples but also comprises all technical equivalents and combinations thereof.

We claim:

1. A machine for selecting and organizing staves for making a barrel, the machine comprising:

an input unit having a stave-measuring station;

a storage assembly defining a space suitable for receiving staves awaiting allocation, said storage assembly cooperative with said input unit so as to receive the staves from said input unit;

a calculation unit suitable for selecting staves from said storage assembly and for forming a collection of staves ready for assembly into the barrel; and an output unit cooperative with said storage assembly, said output unit equipped with a stave-reorientation system.

2. The machine of claim 1, the staves being asymmetrical about a horizontal axis, the staves having a pair of end widths, said calculation unit suitable for selecting the staves so as to be delivered to said output unit in an order and a configuration.

3. The machine of claim 1, said input unit establishing a width of each of the staves at a middle thereof and at opposite ends thereof, said input unit supplying said storage assembly with staves awaiting allocation, each of the staves entering said storage assembly receiving a virtual reference suitable for use by said calculation unit.

4. The machine of claim 1, said storage assembly having a storage device defining a number of locations greater than a number of staves required to make the barrel.

5. The machine of claim 4, said storage device being vertical and being an endless conveyer.

6. The machine of claim 1, said output unit being a device for rotating the staves in a horizontal plane and setting the selected staves down onto an output conveyer belt, said output conveyor belt being connected to an end storage station.

7. The machine of claim 1, further comprising:

an ejection unit cooperative with said storage assembly so as to remove unusable staves from said storage assembly.

8. The machine of claim 1, said calculation unit suitable for measuring a plurality of widths of each stave and for selecting the staves from said storage assembly.

9. A method for selecting and organizing staves used to assemble a barrel, the method comprising:

storing a collection of staves in a storage assembly with each item virtually referenced;

selecting staves from said collection of staves by using a calculation unit; and forming a set of the selected staves on an output unit, said output unit having a device for reorientating the staves.

10. The method of claim 9, each of the staves being asymmetric about a horizontal axis, further comprising:

delivering the selected staves to said output unit in an order and in a configuration.

* * * * *